United States Patent [19]

LaCourte

[11] 4,033,363

[45] July 5, 1977

[54] CUTICLE INSTRUMENT

[75] Inventor: Robert LaCourte, New York, N.Y.

[73] Assignee: Lawrence Peska Associates, Inc., New York, N.Y. ; a part interest

[22] Filed: Apr. 14, 1976

[21] Appl. No.: 677,010

[52] U.S. Cl. ..... 132/73.5
[51] Int. Cl.[2] ..... A45D 29/16
[58] Field of Search ..... 132/73.5, 73, 79, 88.7, 132/88.5

[56] References Cited

UNITED STATES PATENTS

| | | | |
|---|---|---|---|
| 2,513,208 | 6/1950 | Rogers | 132/73 |
| 2,568,328 | 9/1951 | Elby | 132/73 |
| 3,088,470 | 5/1963 | Hall | 132/79 |

*Primary Examiner*—G.E. McNeill

[57] ABSTRACT

A cuticle instrument is disclosed comprising a stick-like member having a hollow reservoir therein for containing a compound to be applied to cuticles. The reservoir is squeezable to discharge a cuticle cream from an end thereof. Both ends of the instrument terminate in edges adapted to engage cuticles so that cuticles may be pushed away from the nail and toward the base of the nail by either end of the instrument.

2 Claims, 4 Drawing Figures

CUTICLE INSTRUMENT

SUMMARY OF THE INVENTION

The present invention relates to a cuticle instrument comprising a hand held, stick-like elongated member readily manipulated by the fingers, the elongated member having a flexible reservoir therein for containing a compount to be applied to cuticles. A discharge opening is provided on the reservoir, the elongated member terminating in both ends in an edge adapted to engage cuticles.

The elongated member in one embodiment is segmented so that each segment is removably joinable to one another, one of the segments containing the reservoir, the reservoir being squeezable between the fingers for discharging a compound to be applied to the cuticles. The discharge member is adjacent one of the edges so that the compound to be applied to the cuticles may be discharged therefrom simultaneously with the pushing of the cuticle away from the nail and towards the base of the nail.

In one embodiment, the elongated member is divided into two segments, so that each of the segments tapers downwardly from the juncture of the segments to the ends thereof.

The reservoir can be charged with a cream such as a vitamin cream, and especially a vitamin A cream obtained by the admixture of carotene with lanolin.

DETAILED DESCRIPTION

Figure 1:
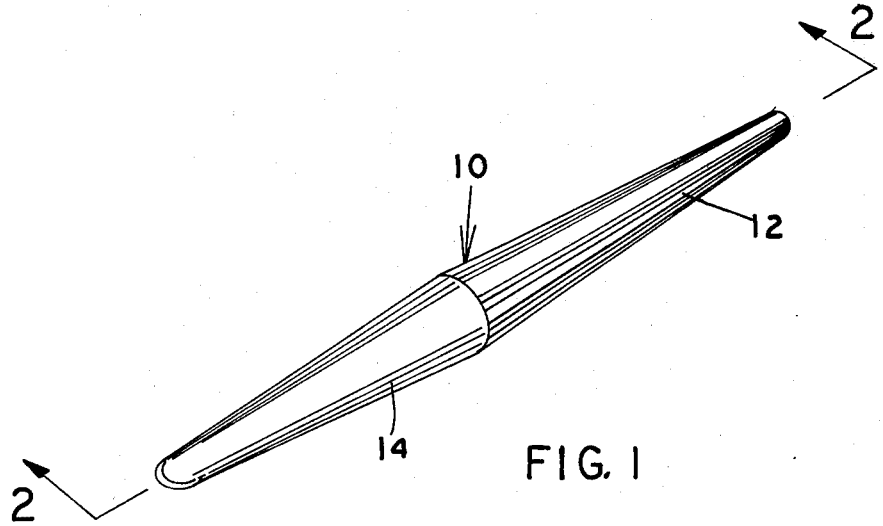
FIG. 1 is a perspective view illustrating a cuticle instrument according to one embodiment of the present invention.
Figure 2:
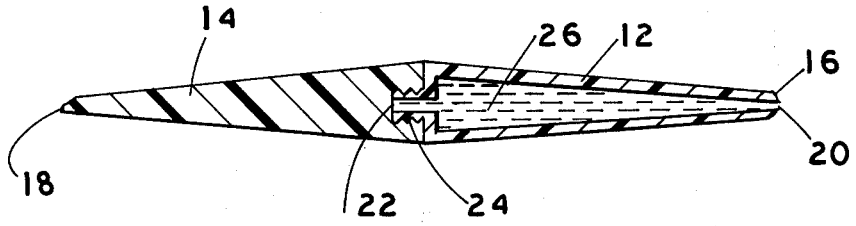
FIG. 2 comprises a plan view in section taken along the line 2—2 of FIG. 1.

Cuticle instruments are disclosed in the prior art U.S. Pat. Nos. 2,615,453 Ohman; 2,513,208 Rogers; 2,480,446 Carlson; 2,219,597 Lutz; 1,715,914 Halk; 1,367,974 Ivory; 1,289,952 Struble; and, 897,810 Amory.

In the manicure or pedicure of nails it is desirable, for purposes of appearance, to move the cuticle away from the nail and towards the base of the nail from which it grows. The cuticle is more easily moved in this direction if it is soft and for this reason, it would be desirable to apply a compound to hardened cuticles to assist in pushing them away from the part of the nail that is overgrown, towards the base of the nail. None of the prior art references disclose apparatus or a method for treatment of cuticles in such a manner.

It is therefore an object of the present invention to overcome these and other difficulties encountered in the prior art.

It is a further object of the present invention to provide a novel cuticle instrument.

It is also an object of the present invention to provide a cuticle instrument having a chamber therein for readily dispensing a compound to be applied to cuticles.

These and other objects have been achieved according to the present invention and will become apparent by reference to the disclosure and claims that follow as well as the appended drawing.

Referring to the drawing, a cuticle instrument 10 is illustrated divided into a plurality of sections, especially sections 12 and 14 terminating in edges 16 and 18 respectively, edge 18 comprising a bevelled edge, both edges being adapted (16 and 18) to engage a cuticle. Segment 12 is joinable to segment 14 by means of a threaded end 24 threadably engaging an opening in member 14, a discharge end 20 being provided in segment 12 and a filler end 22 threadably insertable into a filler reservoir being provided on the other end of segment 12. A compound to be applied to cuticles is stored in reservoir 26 such compound comprising a cream such as a vitamin cream especially a vitamin A cream comprising an admixture of carotene and lanolin. An optional tip 28 having a flat end 30 is provided, tip 28 threadably engageable with section 12 in lieu of segment 14.

Figure 3:
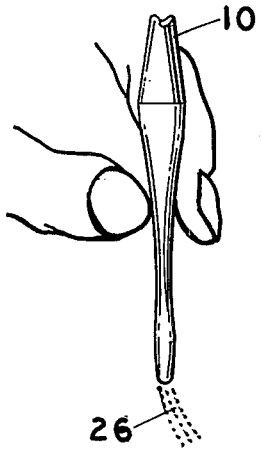
FIG. 3 is a perspective view illustrating the application of a cream or compound to be applied to the cuticles from the instrument illustrated in FIG. 1 according to another embodiment of the present invention.
Figure 4:
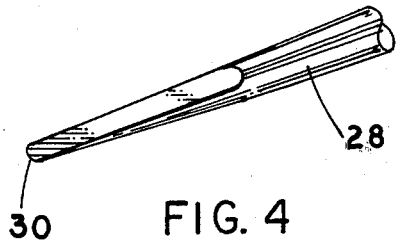
FIG. 4 is a segment of a perspective view illustrating an optional tip which may be attached to the instrument illustrated in FIG. 1 according to another embodiment of the present invention.

In use, the compound stored in reservoir 26 is applied to a cuticle as illustrated in FIG. 3 by squeezing the segment 12 to discharge compound therefrom and when an excess of such compound is discharged it may be pulled back into the reservoir 26 by relaxing the pressure applied by the fingers to segment 12. The ends 18 or 20 are then manipulated to push the cuticle back to the base of the nail.

Although the invention has been described by reference to some embodiments, it is not intended that the novel cuticle instrument be limited thereby but that modifications thereof are intended to be included as falling within the broad spirit and scope of the foregoing disclosure, the following claims and the appended drawing.

What is claimed is:

1. A cuticle instrument for applying a compound to soften a cuticle and for moving cuticles towards the base of a nail comprising a hand-held stick-like instrument having a first section and a second section, said first section terminating in a first bevelled edge and said second section terminating in a second bevelled edge, said first and second bevelled edges being adapted to engage a cuticle, said first section comprising a flexible reservoir having a discharge opening at said first edge and a filler opening at the opposite end thereof, said reservoir being squeezeable between the fingers to discharge a cuticle softening compound through said discharge opening and for retrieving an excessive application of cuticle softening compound by relaxing finger pressure applied to said flexible reservoir, said filler opening having thread means thereon, said second section having thread receiving means at the end thereof opposite said second edge, said thread receiving means being adapted to threadably engage said thread means.

2. The cuticle instrument of claim 1 where said reservoir contains a cream compound to be applied to cuticles.

* * * * *